United States Patent [19]

Retsky et al.

[11] 4,101,803

[45] Jul. 18, 1978

[54] ARC SUPPRESSION AND STATIC ELIMINATION SYSTEM FOR A TELEVISION CRT

[75] Inventors: Michael Walter Retsky, Chicago; James W. Schwartz, Deerfield, both of Ill.

[73] Assignee: Zenith Radio Corporation, Glenview, Ill.

[21] Appl. No.: 802,223

[22] Filed: Jun. 1, 1977

[51] Int. Cl.[2] ..... H01J 23/16; H01J 29/96

[52] U.S. Cl. ..... 315/3; 313/477 R; 313/479

[58] Field of Search ..... 313/477 R, 477 HC, 478, 313/479, 481, 482; 315/3, 58

[56] References Cited

U.S. PATENT DOCUMENTS

| | | | |
|---|---|---|---|
| 3,295,008 | 12/1966 | Gallaro et al. | 315/3 |
| 3,882,348 | 5/1975 | Paridaens | 315/3 X |
| 3,909,655 | 9/1975 | Grimmet | 313/451 X |
| 3,979,633 | 9/1976 | Davis et al. | 313/481 |
| 4,018,717 | 4/1977 | Francel et al. | 313/479 X |

*Primary Examiner*—Alfred E. Smith
*Assistant Examiner*—Robert E. Wise
*Attorney, Agent, or Firm*—John H. Coult

[57] ABSTRACT

This disclosure depicts a television cathode ray tube including an evacuated glass envelope having on an external surface of a funnel portion thereof an outer conductive coating and on an internal surface thereof an inner conductive coating for receiving a high voltage charge. The tube has an electron gun located in a neck of the funnel. The tube is characterized by having an arc-suppression and static-elimination system comprising a discrete, non-distributed arc suppression resistor having a relatively low stray capacitance and having a dynamic impedance value in the range of a few kilohms to tens of megohms, and means for electrically and mechanically coupling said arc suppression resistor between said inner conductive coating and said electron gun, and in electrically parallel combination with said arc suppression resistor, an antistatic coating deposited on an inner surface of the neck around the beam egress from said gun and having a dynamic impedance value which is greater than that of said arc suppression resistor such that said resistor carries the major part of any arc currents flowing through said system, whereby effective arc suppression and static elimination are achieved with high dynamic impedance and with an insubstantial likelihood of said system being by-passed as a result of stray capacitance in the neck region of the tube.

8 Claims, 12 Drawing Figures

Fig. 10
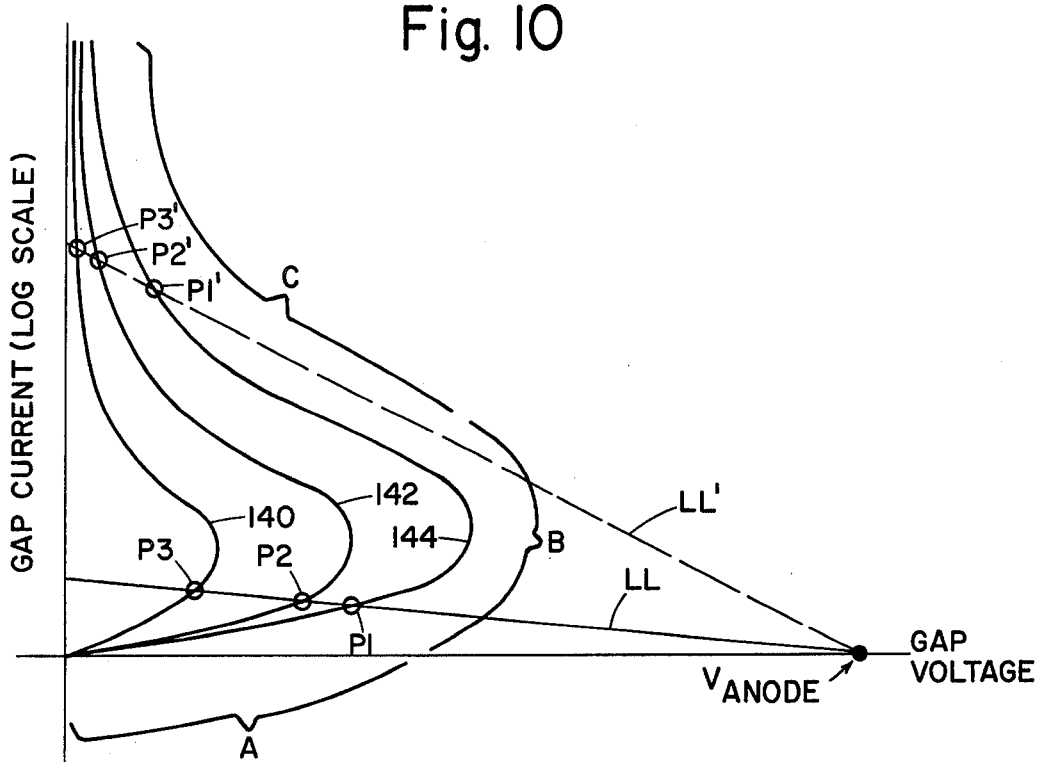
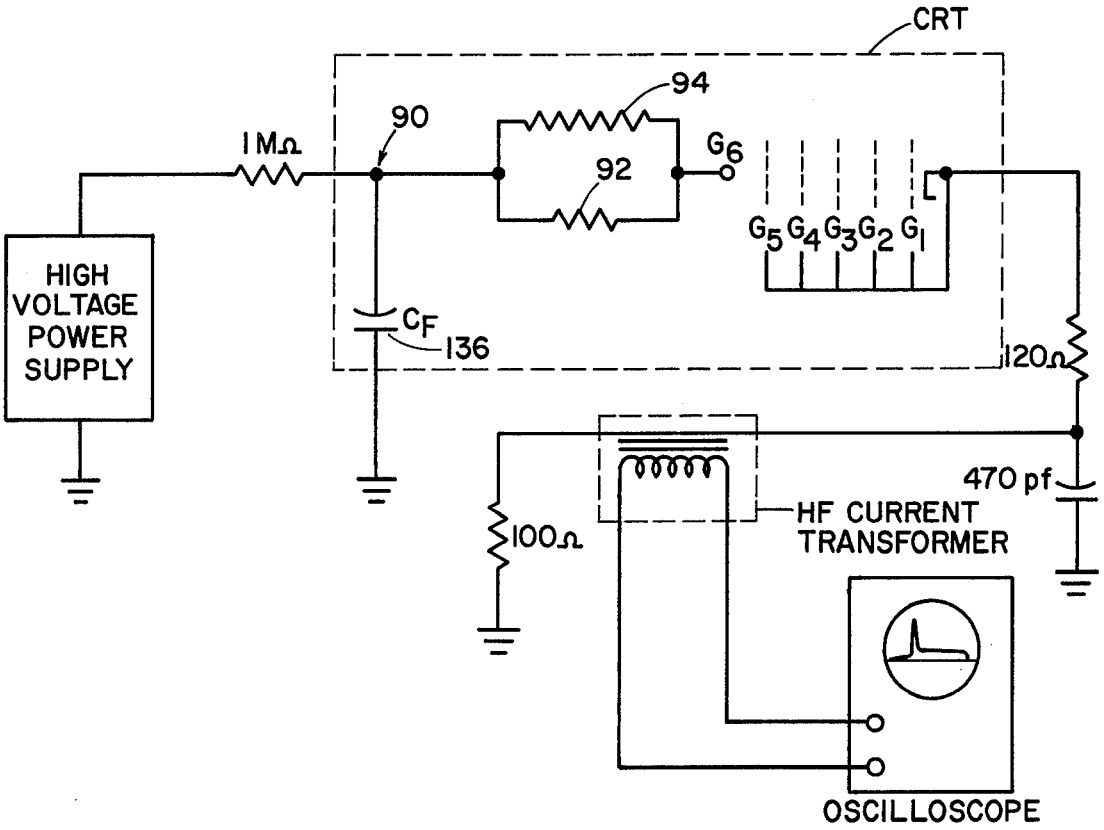
Fig. 11

ARC SUPPRESSION AND STATIC ELIMINATION SYSTEM FOR A TELEVISION CRT

Cross Reference to Related Patent Applications

This application is related to, but not dependent upon a number of copending applications of common ownership herewith, including Ser. No. 708,817, filed July 25, 1976, Ser. No. 803,907, filed June 6, 1977, Ser. No. 830,270, filed September 2, 1977, Ser. No. 811,494, filed June 30, 1977, all assigned to the assignee of the present application.

BACKGROUND OF THE INVENTION

This invention relates primarily to an internal resistive system for television cathode ray tubes for protecting a tube and its associated circuitry from destructive electrical arcs and arc currents and for eliminating static charge accumulations inside the neck of a tube.

The envelope of a television cathode ray tube comprises a glass funnel and a mating faceplate. The funnel has a neck within which is located an electron gun. The faceplate of the tube has a fluorescent screen on which is impressed a very high DC voltage — typically in the range of 20–30 kilovolts or more. The screen is stimulated by one or more electron beams generated in the gun.

Conductive coatings on the inside and outside of the funnel serve as a large capacitor which filters the high voltage supplied to the screen. The inner conductive coating is at screen potential and also serves to transmit the screen voltage to the neck of the tube where it is applied to a high voltage anode electrode at the forward end of the electron gun.

The electron gun has one or more cathodes and a series of closely spaced electrodes which shape, accelerate and focus the electron beam(s) generated in the gun. To accomplish these functions, the various electrodes require widely different electrical potentials. The large voltage differences established between certain high voltage and low voltage electrodes in the gun creates a susceptibility to arcing between the electrodes, e.g., shoudl there exist particulate foreign matter in an interelectrode space, a burr on an electrode, a misaligned or improperly spaced electrode, or the like. Large voltage differences between the gun electrodes and other tube internal components also establish arc-conducive conditions. When the conditions for arcing exist, the high voltage filter capacitor, with its immense stored electrical energy, will within a few microseconds or less dump its stored charge.

Because the instantaneous peak arc currents can reach hundreds of amperes in magnitude, great destruction can be wrought by such arcs. External circuitry can be damaged by transient currents and voltages induced in the associated receiver circuitry. Internal gun parts can be eroded to the point of inoperability or severely reduced in their effectiveness. High arc currents are capable of sputtering electrode materials onto adjacent surfaces, resulting in the formation of electrical leakage paths. Further, arcing in a tube during its normal operation can result in a loud audible report which may be quite disturbing to a viewer.

In recent years, the design evolution of color picture tubes has taken a direction tending to exacerbate the arcing problem. The desing for greater picture brightness has driven the screen voltages inexorably upward toward and even beyond 30 kilovolts. A trend toward wider beam deflection angles and a desire to minimize power consuption have dictated the use of tubes with smaller neck diameters. A small neck diameter implies a more closely confined environment for the electron gun, with the attendant increased probability of arcing between components of the electron gun assembly or between the gun assembly and the containing tube envelope.

In order to reduce tube arcing, it is routine today to design color tubes and electron gun assemblies with every effort to maximize intercomponent spacing, to minimize points of field concentration, and otherwise to configure the tube and gun structures to minimize the tendency of a tube to arc. After a tube receives its electron gun and the envelope is sealed, it is commonplace to "spot-knock" (high voltage condition) the gun. "Spot-knocking" is an operation wherein a pattern of fluctuating and constant voltages of high magnitude are applied to the tube to "knock" (remove) loose particles which may have lodged between gun electrodes, burrs on electrode parts, and other agents which might lead to arcing of the tube during its normal operation. Typically peak voltages during spot knocking are much higher than the screen operating voltage. Spark gaps, diodes, filters, gas discharge lamps, decoupling circuits, and other protective devices are commonly provided in the associated receiver (at significant cost) to protect receiver circuitry from damage by arc-induced currents and voltages.

Television picture tube manufacturers have long attempted to develop an internal resistive element which would be coupled in series with the high voltage filter capacitor and the electron gun to suppress the magnitude of arc currents and thereby overcome the potentially destructive effects of arcing in the tube during tube operation.

The requirements for such an internal resistance element are, however, extremely severe — so severe that prior to this invention no commercially acceptable internal resistive element or system has been developed. Following are some of the requirements, not necessarily in their order of importance, of an internal resistive element for protecting television picture tube against arcing.

Requirement 1. The resistive element must be compatible with the clean high vacuum environment inside a cathode ray tube. The element cannot emit gas which might significantly decrease the tube's vacuum level or impair the performance of the cathode in the electron gun assembly. The element cannot flake, erode, ablate, or otherwise generate particles which might block openings in a color selection electrode or lodge in a gap between gun electrodes.

Requirement 2. The resistive element must be compatible with the tube's fabrication processes. Perhaps the most severe of the fabrication processes are the high temperature cycles which a color tube is subjected to when the faceplate is sealed to the funnel and during exhausting (and sealing) of the tube. Temperatures may reach 430° C or higher during these high temperature operations.

Requirement 3. The resistive element cannot be physically obtrusive to the electron beams. As noted, there is a very limited amount of space available in the neck of a television cathode ray tube, particularly a tube of the small neck type, and particularly in the region near the front of the electron gun. Because of this space limitation, it has proven to be difficult to design a non-obtrusive discrete internal resistive element.

Requirement 4. The resistive element must be capable of being satisfactorily electrically terminated at each end. If the resistive element is a neck coating, it has been found that even modest arc currents are apt to cause localized heating of the glass underneath the contact point(s) with the result that the glass may chip or become predisposed toward eventual failure. It is difficult to maintain contact integrity with such an element after a number of arcs have occurred.

Requirement 5. The television industry being highly competitive, the resistive element and its cost of installation must be low enough to be commercially viable.

Requirement 6. Another requirement is that the resistive element not be susceptible to being by-passed by an arc as a result of the deposition of conductive material during flashing of a getter in the tube. Specifically, all television cathode ray tubes today utilize a "flashed" (vaporized) "getter" material which "gets" (adsorbs) residual gas in the tube after the tube has been pumped down as far as is practicable and sealed off. The gas-adsorptive getter material most commonly employed is a barium compound. Barium is highly conductive, however. When the getter is flashed, a conductive barium coating is deposited on substantially all exposed areas within the tube. In order to "get" the greatest quantity of residual gas, the getter must be flashed over a wide area inside the tube; inevitably, getter material is deposited on the resistive element. It is clear that any resistive element used for arc suppression or static elimination will be effectively by-passed or nullified if a shunt path around the resistive element or a major part thereof is created by conductive getter material.

Requirement 7. Yet another requirement is that the resistor not break down at operating or conditioning ("spot-knocking") voltages.

Requirement 8. A very important requirement is that the effective impedance of the resistive element be within an appropriate resistance range. If the dynamic impedance of the element is too low, e.g. below a few kilohms, inadequate suppression of arc currents will be provided. A resistive element may have an appropriate DC resistance measured outside of the tube but, when situated in a finished tube, be shunted by a stray capacitance which is so high as to establish a low dynamic parallel impedance across the element. It is believed that the afore-described stray capacitance problem has not been fully appreciated by prior practitioners in the art.

If the DC resistance of the element is too high (e.g. $10^{12}$ ohms), the material will act as an insulator and collect stray charges which may alter the electron beam paths or initiate arcing. Further, if the DC resistance of the element is too high, the voltage drop across the element as a result of gun leakage current flowing through it will result in an intolerable drop in the voltage applied to the anode electrode of the gun.

PRIOR ART

Our approach disclosed in the prior art is to deposit an electrically resistive coating on the inner surface of the envelope at the lower end of the tube funnel or in the neck, which coating makes contact at one end with the inner conductive coating on the funnel and at the other end with the electron gun assembly. Perhaps the first patent to suggest such an approach to arc suppression is U.S. Pat. No. 3,829,292-Krause. See also U.S. Pats. Nos. 3,555,617; 3,961,221 and German Pat. No. 2,634,102.

U.S. Pat. No. 3,979,633 discloses a color cathode ray tube having an arc suppressive resistive coating between the gun and the inner conductive coating on the funnel. FIG. 1 is in part a reproduction of the first figure in prior art patent No. 3,979,633. The 3,979,633 patent discloses a color cathode ray tube 11 having a neck 13, a funnel 15, and face panel 17. The funnel 15 has an outer conductive coating 29 and an inner conductive coating 33. The inner conductive coating 33 is accessed through a high voltage anode button 35 passing through the funnel wall. The outer and inner conductive coatings form a smoothing filter capacitor for high voltage supplied to the tube from a high voltage power supply 36. Circuitry for driving the tube's electron gun is shown schematically at 38. Power supply 36 and gun drive circuitry 38 have been added to FIG. 1 of 3,979,633 for clarity of illustration.

The FIG. 1 prior art tube is disclosed as including an arc suppression system comprising a "high resistive coating" 39 on the interior surface of the funnel 15 in the region at which the neck 13 joins the funnel. The resistive coating 39 is electrically joined at its forward end with the inner conductive coating 33. At its rearward end, it is contacted by a snubber spring 49 on an anode electrode 45 constituting part of the electron gun assembly.

The resistive coating 39 is said to be comprised of a glass frit-based composition having, for example, suitable metallic oxide inclusions. The resistive coating is said to have a resistivity of, for example, $10^5$ to $10^7$ ohms per square. The arc suppression system described is said to provide a resistive path between the conductive anode button 35 and the anode electrode 45 of the gun assembly having a DC resistance value of 0.5 – 10 megohms. It is said that in tubes employing the described arc suppression system peak arc currents seldom exceed 0.5 to 1.0 amperes.

The 3,979,633 patent disclosure asserts that prior art systems which use an arc suppression coating, such as disclosed in U.S. Pat. No. 2,829,292, are deficient in that "it was found that getter and other sublimation deposits within the tube tended to bridge the resistance coating, thereby decreasing the intended benefit" (column 2, line 7). The 3,979,633 patent, in order to provide arc suppression while preventing the shorting of the high resistive coating 39 by deposited getter material, provides a modification of the getter "having a discretely shaped diffusion director integral therewith and oriented on a component structure within the tube to discretely direct the effusion of getter material in a manner to prevent the formation of a conductive path across the high resistive coating 39" (column 4, lines 45–50).

Two different getters are shown in FIG. 1 — one at 51 and the other at 63. Each of the getters is structured and orientated with the intent that when it is flashed, the getter material does not fall upon and short circuit the high resistive coating 39.

The disclosed 3,979,633 patent approach of averting the getter flash deposition pattern away from the high resistive coating 39 in order to prevent shorting of the coating, is believed to be unsatisfactory. Getter 63 is located on the shadow mask and is not removable from the tube when the neck is taken off to salvage and reconstitute the tube. Also, attachment of the getter 63 to the mask is apt to alter the mechanical or thermal characteristics of the mask. Regarding getter 51 — it is known to be difficult to mount a ring getter about the beam egress from the gun which does not interfere with the electron beams. Also, it has been found that ring getters mounted within the neck are in an inefficient position for maximizing getter flash area and getter pumping efficiency. Also, such ring getters produce an undesired back diffusion of getter material on nearby gun parts.

An arc suppression coating deposited on the inner surface of the neck and funnel rules out the use of a gun-mounted antenna-type getter, with its attendant universally recognized advantages, lest the arc suppression coating be shunted by the antenna strap.

Another serious problem associated with an arc suppression coating on the inner surface of the envelope is the high stray capacitance which can be created, especially when the tube is assembled and the yoke and other external components are mounted on the neck of the tube.

Let us explore further the effects of the stray capacitance, sometimes referred to as parasitic capacitance, which exists in the neck region of a television CRT, specifically a tube which has an arc suppression resistor in series with the high voltage filter capacitor and the electron gun. FIG. 2 is a hypothetical curve of arc current versus time during an arc in such a television CRT. FIGS. 3, 4 and 5 are schematic stray capacitance diagrams at three different times during an arc. In FIGS. 3, 4 and 5, $C_F$ is the high voltage filter capacitor on the funnel of the tube. $C_{S1}$ represents stray capacitance existing across the arc suppression resistor R. $C_{S2}$ represents stray capacitance across a gun interelectrode gap G. $C_{S3}$ represents stray capacitance between some intermediate point on the arc suppression resistor and the negative side of the filter capacitor $C_F$ (typically at ground potential). It should be understood that whereas only stray capacitances $C_{S1}$, $C_{S2}$, and $C_{S3}$ are shown, in reality stray capacitance exists between each point and all other points on the internal tube components.

FIG. 3 illustrates the condition inside the tube at time $t_0$ before an arc has been initiated. FIG. 3 schematically shows that a high voltage derived from the charged filter capacitor $C_F$ appears across an interelectrode gap G. Between $t_0$ and $t_1$ (before an arc actually occurs) it is known that a low level flow of charge builds up. This will be called the precursor ramp. At time $t_1$ the gap G is closed, as by a conductive discharge plasma bridging the gap G.

FIG. 4 depicts events between times $t_1$ and $t_2$. As a result of the closing of gap G, the high voltage developed across capacitor $C_F$ now appears across the arc suppression resistor R, causing the stray capacitance $C_{S1}$ to charge up and the previously charged stray capacitance $C_{S2}$ to discharge nearly completely and capacitance $C_{S3}$ to partially discharge. The result is a very brief current transient. The main arc current has not yet begun to flow. This second stage of the arc development will be called the precursor spike. It is shown in FIG. 2 between times $t_1$ and $t_2$.

The RC time constant associated with the tail of the spike in FIG. 2 between times $t_1$ and $t_2$ is that associated with the magnitude of the stray capacitances and the effective resistance in series therewith. If the stray capacitances within a tube are large enough and the attenuating resistance low enough, the power generated in this precursor spike can be of sufficient magnitude to cause damage to tube components or to induce currents or voltages in the associated receiver of sufficient magnitude to injure circuit components or impair receiver performance. Further, even when of insufficient intensity and/or duration of itself to cause tube or receiver impairment, the precursor spike can, and often does, produce gases within the tube or otherwise contribute to conditions which will insure the immediate occurrence of a main arc discharge.

FIG. 5 illustrates the condition existing between time $t_2$ and $t_3$ when the high voltage filter capacitor is dumping its charge through the arc suppression resistor R; $t_3$ represents a time at which the arc self-extinguishes. The portion A of the FIG. 3 curve between times $t_2$ and $t_3$ is the RC curve associated with the discharge of the capacitor $C_F$ through the arc suppression resistor R. The higher the product of $C_F$ and R (the longer the RC time constant), and the lower is $I_D$ (the peak current associated with the discharge of capacitor $C_F$), the less will be the arc power which must be dissipated and the lower the likelihood of component damage and/or receiver performance impairment. The total duration of an arc discharge, including the precursor events, is no more than a few microseconds. The precursor events are much less than a microsecond in duration.

It is believed that the ideal arc suppression system should perform a number of functions. It should suppress the precursor ramp with the aim of quenching an arc before the second stage precursor spike occurs. Failing that, it should attenuate the peak height and duration of the precursor spike to reduce the damage caused by the spike and to diminish the likelihood of a main arc discharge occurring. Upon the occurrence of a main arc discharge, the arc suppression system should suppress the amplitude of the peak main discharge arc current ($I_D$ in FIG. 2) to no more than a few amps — preferably less than one amp. At such low levels the dissipated arc power is not of sufficient intensity to cause damage to the tube or associated receiver.

A realization of the objectives of the ideal arc suppression system necessarily requires that any stray capacitance associated with the system be minimized. A low level of stray capacitance will reduce the energy level of the precursor ramp and precursor spike, reducing the level of generated charged particles and gas which we believe may act to trigger a main arc discharge. If the stray capacitance is small enough, the precursor spike may be precluded altogether. A low level of stray capacitance during the main arc discharge will prevent a serious diminution of the effective dynamic impedance of the system to arc currents.

It is worth noting that in a conventional television CRT without arc suppression, the arc-current-versus-time curve, corresponding to FIG. 2, is a towering spike which may reach 1000 amperes peak current, or greater. The potential for destruction of arc currents of such magnitude is obvious.

Before leaving FIG. 4, it should be noted that at the vary instant the arc is initiated, the voltage at the positive side of the stray capacitance $C_{S3}$ may approach the high voltage across the capacitor $C_F$. This means that very high voltage gradients may be impressed across a portion of the arc suppression resistor, greatly increasing the possibility that the resistor will break down and be by-passed by an arc. In FIG. 2, the rising curve B shows how the arc current might rise if the arc is able to by-pass the arc suppression resistor. The arc power in the case of a by-passing of the arc suppression resistor is very much greater than when the arc suppression resistor is in series with the capacitor $C_F$ acting to dissipate the stored energy in the capacitor $C_F$.

Although the part played by stray capacitance within a television CRT during arcing of the tube has not been widely recognized, there has been some limited appreciation of the effects of stray capacitance evidenced in certain prior art patents. For example, this subject is discussed in some detail in U.S. Pat. 3,909,655-Grimmet et al, column 4, lines 49 et seq. Grimmet et al in column 4 (line 64) states: "It has been found that the presence of a resistor between the internal coating and the final anode contributes to the stray capacitance in a manner which depends mainly upon the physical size of the electrically conductive material of the resistor." At the top of column 5 Grimmet et al. goes on to say it was found that in a cathode ray tube having a resistor in which the resistive element is deposited on the inner surface of the neck of the envelope, the stray capacitance is 20 picofarads, whereas in a cathode ray tube differing only in that the resistor is constructed and arranged as described in Grimmet et al., the stray capacitance is 3 picofarads. The Grimmet et al. design does not show the arc suppression resistor on the inner surface of the envelope, but rather places it on the inner surface of an insulative cylinder which is mounted on the forward end of the electron gun and coaxial therewith.

Grimmet et al. leads us to a discussion of the second basic approach to providing arc protection by means of an internal arc suppression resistive element. This second approach is to provide a discrete resistor between the inner conductive funnel coating and the forward end of the electron gun.

The Grimmet et al. arc suppression resistor is, as noted, of the discrete type. Another arc protection execution quite similar to Grimmet et al. is disclosed in U.S. Pat. No. 3,882,348-Paridaens. The Paridaens patent discloses an arc suppression resistor in the form of a cylinder coaxially mounted on the end of a three-beam electron gun. A 500-ohm helical resistive wire is coiled around the outside of the cylinder and is connected in series with the inner conductive coating on the funnel and the anode electrode of the gun. The cylinder is constructed of a ceramic material having "some but very small conductibility." The resistance of the cylinder is said to be $10^8$ ohms — a value selected to prevent charging of the surface of the cylinder.

By placing the resistive element on the outside of the ceramic cylinder, the Paridaens approach will not achieve the reduction in the stray capacitance sought by Grimmet et al.; recall that in Grimmet et al. the resistive element was placed on the inner surface of an insulative cylinder. However, like Grimmet et al., the Paridaens ceramic cylinder mounted on the forward end of the gun is very apt to interfere with the electron beams. The low resistance value (500 ohms) and physical shortness of the Paridaens resistor are deemed to be further shortcomings of the Paridaens approach.

The referent copending application Ser. No. 708,817 describes and claims a discrete arc suppression resistor with a provision for shadowing the exposed surface of the resistor from getter flash deposits. In one embodiment disclosed, the resistor is in the form of a cylinder mounted on the forward end of the electron gun and supporting the getter assembly.

U.S. Pat. No. 3,295,008-Gallero et al. expounds another prior art disclosure of a discrete arc suppression resistor. In Gallero et al. the resistor is a small element forming part of a snubber spring assembly. The Gallero et al. resistor avoids the beam interference problem but suffers from the fact that getter flash deposits on the surrounding neck inner surfaces and on the resistor itself will quite likely act to permit a by-passing of the resistor by an arc. Also, the physically short Gallero resistor will, we believe, be easily jumped over by an arc.

Thus, prior art discrete resistor designs, if of the cylindrical type, effectively shield the neck from stray electrons but suffer from their tendency to obstruct the electron beams. If of the non-shielding type (as is Gallero et al.), they are apt to be easily by-passed by an arc.

Another important consideration in the design of television cathode ray tubes is to assure that no static charge is built up in the neck of the tube which could initiate arcing or create stray electrical fields capable of diverting the electron beams from their intended paths. In conventional television CRTs (which do not have arc suppression systems), the inner surface of the neck is coated with the same colloidal graphite material which serves as the inner conductive coating on the funnel. Such a conductive neck coating is effective to drain off any stray charge falling on the inner wall of the neck and prevent charging up thereof.

However, in any system which has an arc suppression resistor, it is not so easy to provide means for draining off stray electron charge. If the same inner conductive coating is used as is employed in conventional tubes without arc suppression systems, then a very high stray capacitance is established in the neck of the tube, with the afore-described inevitable by-passing by arcs of the arc suppression resistor system. If a system such as discussed above is used wherein a resistive coating is deposited on the inner surface of the neck to serve as an arc suppressor (and static charge drain), then there arises the afore-described glass-chipping, contact integrity and other problems associated with resistive neck coatings which are expected to carry arc currents.

OTHER PRIOR ART

U.S. Pat. No. 3,267,321
U.S. Pat. No. 3,469,049
U.S. Pat. No. 3,950,667
U.S. Pat. No. 3,758,802

OBJECTS OF THE INVENTION

It is an object of the present invention to provide for television cathode ray tubes an improved electrically resistive system for arc suppression and static elimination which abstracts the attributes of systems utilizing resistive envelope coatings and systems utilizing discrete arc suppression resistors, without also incorporating the drawbacks thereof.

It is another object to provide such a resistive system which provides a high dynamic impedance to arc currents due in part to its having a relatively low value of stray capacitance.

It is yet another object to provide such a system which is low in manufacturing cost and permissive of use with the popular antenna-type-gun-mounted getters.

It is still another object to provide an arc suppression-/anti-static resistive system for a television CRT which does not dissipate arc power in an envelope coating and thus which is believed to result in a more reliable tube.

It is another object to provide an arc suppression system for a television CRT which suppresses arcs so effectively as to greatly reduce the number, as well as the intensity, of the arcs which do occur.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 10 is a voltage-versus-current plot of a hypothetical arc gap circuit in a television CRT which is useful in understanding an aspect of the present invention.

FIG. 11 is a schematic diagram of test apparatus used to measure the dynamic impedance which the system of the present invention presents to an arc current.

DESCRIPTION OF THE PREFERRED EMBODIMENTS

Figures 6, 6A, 7:
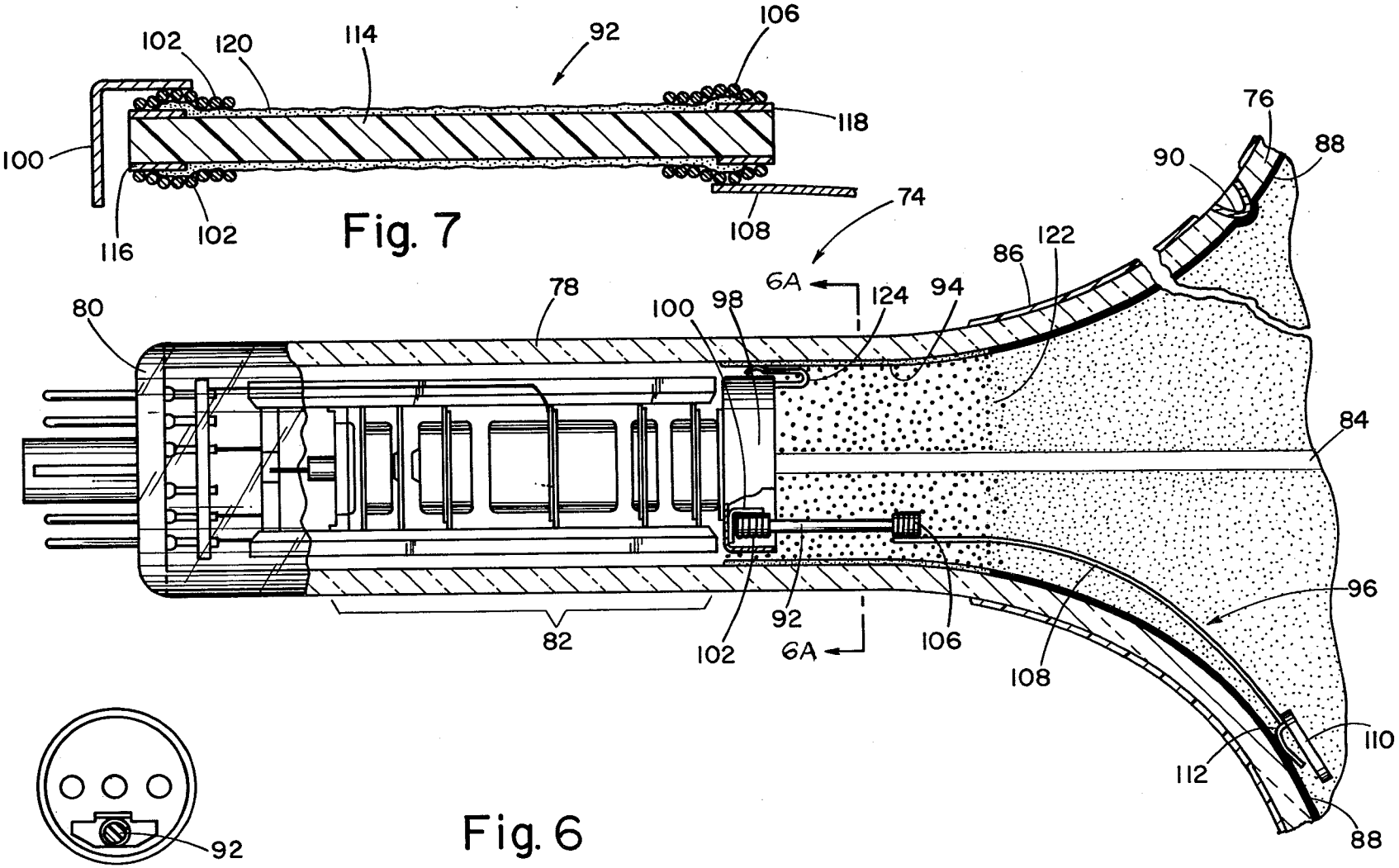
FIG. 6 is a sectional side view of a portion of a color cathode ray tube embodying the teachings of the present invention.
FIG. 6A is an enlarged front elevational view of an electron gun comprising part of the FIG. 1 tube.
FIG. 7 is an enlarged view of a discrete arc suppression resistor shown in FIG. 6.

The present invention concerns a resistive system for use in television cathode ray tubes for protecting the tube and associated receiver circuitry from arcs and arc currents, and also for eliminating static charge from the interior of the neck portion of the tube. A preferred implementation of the principles of the present invention will now be described. FIG. 6 is a sectioned side view of a portion of a color cathode ray tube embodying the present invention. Before discussing the present invention, however, certain tube components which comprise the environment for the present invention will be described.

The FIG. 6 implementation of the present invention is shown as including a portion of a glass funnel 76 joined with a neck 78. The neck 78 is terminated by a base 80 supporting a number of pins through which electrical communication is made between the television chassis and the interior of the tube 74.

In the nck of the tube is disposed an electron gun assembly 82 which generates three coplanar beams, shown edge-on at 84. The tube includes an outer conductive coating 86 which is maintained at ground potential and an inner conductive coating 88 which receives a high voltage from an exterior source (not shown) through an anode button 90. The inner and outer conductive coatings 86, 88 constitute a high voltage filter capacitor and may be of conventional composition. The capacitance value of the filter capacitor of a modern color CRT is typically in the range of 1000–2000 picofarads.

In accordance with this invention, the tube 74 includes an arc-suppression/anti-static resistive system including a discrete arc suppression resistor and, in parallel therewith, an anti-static neck coating. As will become more evident hereinafter, the resistive system according to this invention has a number of unique properties. To prevent stray capacitive by-passing of the resistive system by arc currents, the system has a stray capacitance which is low in value. The very modest stray capacitance is, for the most part, serially coupled with large resistance to strongly damp arc currents charging and discharging the stray capacitance. Having both a large D.C. resistance and a very large capacitive reactance (due to the low value of the stray capacitance), the overall dynamic impedance of the system of resistive elements is high.

Whereas numerous other embodiments are contemplated, a preferred embodiment is depicted in FIGS. 6. The preferred embodiment comprises a parallel combination of a discrete arc suppression resistor 92 and an anti-static coating 94 on a portion of the neck surrounding the beam egress from the gun. Antistatic coating 94 will be discussed, followed by a detailed treatment of the arc suppression resistor 92.

In accordance with the present invention, the antistatic coating 94 comprises an important component of the resistive arc suppression system which includes itself and the arc suppression resistor 92 (to be discussed later). To meet the objectives of the invention, the antistatic coating serves to drain off stray charge and to transmit the high voltage on the funnel inner conductive coating 88, yet does this with a low cost coating with a low stray capacitance which serves to damp stray capacitive charging currents (or discharging currents), and which otherwise meet the afore-stated requirements of an intenal resistive element for a CRT.

The anti-static coating 94 overlaps and makes electrical contact with the inner conductive coating 88 along an overlap 122. At the gun end of the anti-static coating 94, the coating is electrically and physically contacted by a plurality of snubber springs 124 carried by the anode electrode 98. A uniform anode potential is provided in the area of the anti-static coating 94 by means of the high voltage applied to the inner conductor 88. As will be described in detail hereinafter, the preferred material for the coating 94 is resistive frit. In a subsequent section the part played by the anti-static coating 94 and its features and attributes will be described at length.

The arc suppression resistor 92 will now be discussed. In accordance with the present invention, the arc suppression resistor is a discrete element which serves as the main arc current dissipating constituent of the resistive system. In the illustrated preferred embodiment the arc suppression resistor is low in cost, produces a very low stray capacitance, is non-obstructive to the electron beams, is usable with a conventional and highly desirable gun-mounted antenna-type getters, and otherwise meets the afore-stated requirements for a CRT internal resistive element.

The arc suppression resistor 92 is mounted on an anode electrode 98 constituting part of the last element of the main focus lens of the gun assembly 82. It, in turn, supports a getter 96. See FIGS. 6, 6A and 7. The arc suppression resistor 92 is supported by a bracket 100 welded to a coil spring connector 102. At the opposite end of the resistor 92 is a second coil spring connector 106 which is similar to the connector 102. The particular structure of the resistor 92 and its terminations does not constitute an aspect of the present invention, per se, but rather is described and claimed in the referent copending applications Ser. Nos. 811,494, filed June 30, 1977 and Ser. No. 830,270, filed Sept. 2, 1977.

Although a variety of other resistor configurations are contemplated, in the illustrated preferred embodiment the resistor 92 is shown as comprising a cylindrical rod 114 on the opposed ends of which are deposited conductive termination coatings 116, 118 — nickel, silver, iridium, or gold, for example, which assure sound electrical contact with a high resistivity coating 120. A high resistivity coating 120 overlaps the metal termination coatings 116, 118 in order to assure the integrity of the electrical connection therebetween under high vacuum arcing conditions.

Briefly, the coil spring connectors 102, 106 serve to provide a sound mechanical and electrical connection with the ends of the resistor 92. The connectors 102, 106 are expanded coil springs and very securely grasp an inserted end of the rod. Due to their compliant nature they follow the step at the end of the high resistivity coating 120 and make good electrical contact with not only the metal termination coatings 116, 118, but also with the end of the high resistivity coating 120. After the connectors 102, 106 have been permitted to constrict upon the ends of the rod 114, they are locked in place by welding on the bracket 100 and getter support 108.

The arc suppression resistor 92 has an optimum length. If the resistor is too short, the resistance of the resistor and its protection against arcing is reduced. If the resistor is excessively long, it will intrude into the electron beam deflection space. It has been found that the length of the resistor, in a 100° deflection, narrow-neck, in-line gun environment as shown, should be between 1.0 and 1.75 inches, preferably about 1.5 inches. The dynamic impedance of the resistor should fall somewhere in the range of a few kilohms to a few tens of megohms. At the low end of this range the arc protection provided is marginal. At the high end of the range the IR drop through the resistor 92 due to leakage current through the resistor begins to adversely reduce the voltage on the anode electrode of the gun assembly 82. It has been found that a preferred dynamic impedance for the arc suppression resistor 92 is in the range of about 0.1 to 5 megohms.

An electrically conductive leaf spring getter strap 108 is welded to the coil spring connector 106 and at its distal end carries a getter pan 110. The pan 110 is supported on runners 112 in firm physical and electrical contact with the inner conductive coating 88. Thus is the high electrical potential on the coating 88 conveyed to the anode electrode 98 of the gun assembly 82.

The pan carries a quantity of conventional getter material — for example a gas-doped barium compound. The getter is "flashed", i.e. the getter material is vaporized, to coat the inner surfaces of the tube by heating the pan using an RF induction source located outside the tube enclosure.

Should conditions exist for an arc to occur in the gun, for example, as a result of a foreign particle lodging in a narrow inter-electrode space in the gun assembly 82, an arc current will propagate through the getter runner 112, strap 108, arc suppression resistor 92, through the gun assembly 82 and associated gun drive circuitry to a ground within the receiver.

Figure 8:
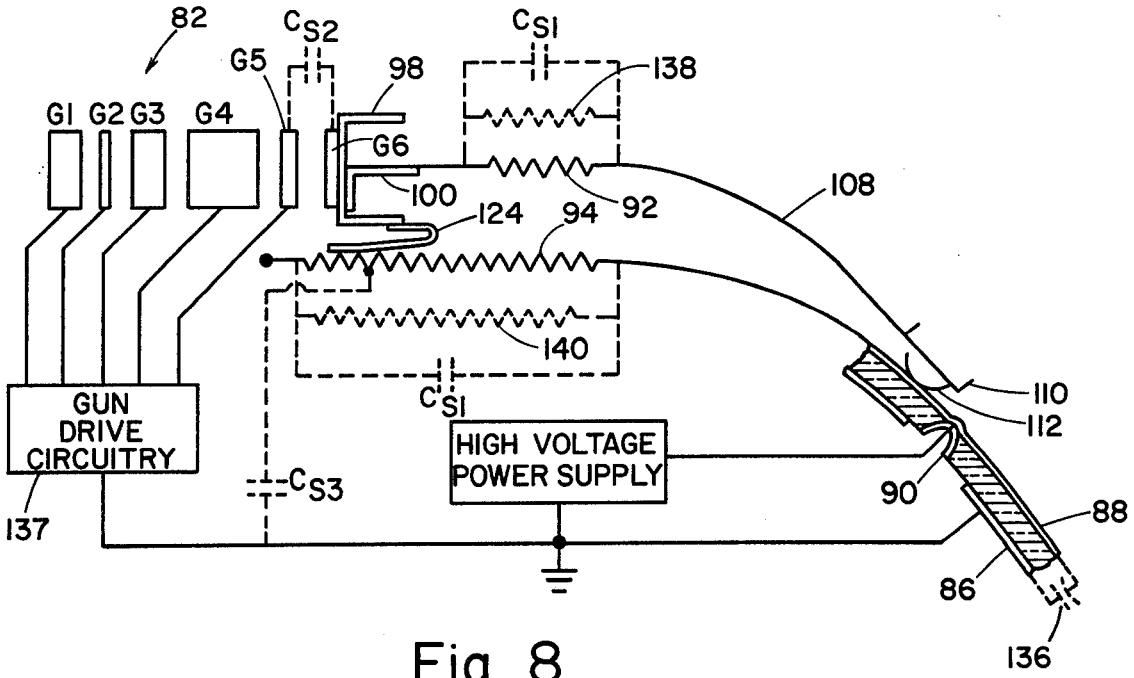
FIG. 8 is an electrical schematic representation of the tube components shown in FIG. 6.

A detailed discussion of the system of parallel resistive elements according to the present invention for accomplishing arc suppression and static elimination will now be engaged, particularly with reference to FIG. 8. FIG. 8 is an electrical schematic diagram of the components of the FIG. 6 tube which are related to arcing, arc suppression or static elimination. The same reference numerals are used in the FIG. 8 electrical schematic diagram as used for corresponding structure in FIG. 6.

The high voltage filer capacitor constituted by the outer and inner conductive coatings 86 and 88 is shown symbolically in dotted lines at 136. It can be seen from FIG. 8 that the charged coatings 86 and 88 constitutes a large storage capacitor 136 (1000–2000 picofarads, e.g.) ready at all times during tube operation to dump its charge to ground through any break-down receptive pathway. It will be recognized that a protruding burr on one of the electrodes on the gun assembly 82 or a foreign particle in an inter-electrode space will create an arc inducive condition. Upon the occurrence of an arc, the high voltage filter capacitor 136 will dump its charge through the parallel-connected arc suppression resistor 92 and the anti-static coating 94, through the anode electrode 98 and thence through the gun drive circuitry 137 to ground.

The relative values of the arc suppression resistor 92 and the anti-static coating 94 are important, at least in applications wherein the net impedance of the parallel pair of resistors 92 and 94 is at the low end of the range of acceptable values. In applications wherein the net dynamic impedance of the system is quite low, for example, 10–100 kilohms, the level of arc current when arcing occurs would normally be in the range of a few amperes. At this level of arc current, it is desirable that the major part of the arc current pass through the arc suppression resistor 92 since the resistor is designed to withstand arc currents at much higher levels than that. For the reasons given above, it is not desirable to pass large arc currents through an envelope coating. This means that in applications wherein the net impedance of the parallel system is 10–100 kilohms or so, the resistance of the arc suppression resistor should be much less (1/10 or less, e.g.) than the resistance of the anti-static coating 94. By this expedient, the amount of arc current that will pass through the anti-static coating 94 is low enough to avoid any possibility that the arc currents might chip neck glass, erode contact points or damage the coating 94.

The preferred dynamic impedance under arc conditions for the parallel resistive network comprising resistor 92 and coating 94 is in the order of 0.1–5 megohms. With an impedance in that range, any arc currents that will result will be relatively modes (less than 1 ampere). It is not so important therefore that a major portion of the arc current be diverted away from the anti-static coating 94. It is desirable that the anti-static coating not have a D.C. resistance much greater than $10^9$ ohms, since at the level the RC time constant associated with the discharge of stray charge from the coating begins to exceed a desirable maximum time inteval. The D.C. resistance value of the parallel resistive network is preferably not greater than 30–50 megohms since above that range the IR drop resulting from gun leakage current flowing through the network will result in an unacceptable drop in the voltage on the anode electrode 98. In the preferred embodiment the anti-static coating has, for example, a resistance in the range of $10^7$ — $10^9$ ohms. In the preferred embodiment the resistance value of the arc suppression resistor 92 is preferably about 0.1–5 megohms.

In FIG. 8 there is shown in dotted lines a resistor 138 shunting the arc suppression resistor 92. Resistor 138 is intended to symbolically represent a conductive arc path along the surface of the resistor which by-passes the body of the arc suppression resistor. As will be explained in more detail hereinafter, if safeguards are not taken, getter-flash deposits may provide a surface arc conduction path around the body of the resistor 92. Resistor 138 represents this surface conduction path. A similar surface conduction by-pass path around the anti-static coating is symbolized by resistor 140.

Figure 3:
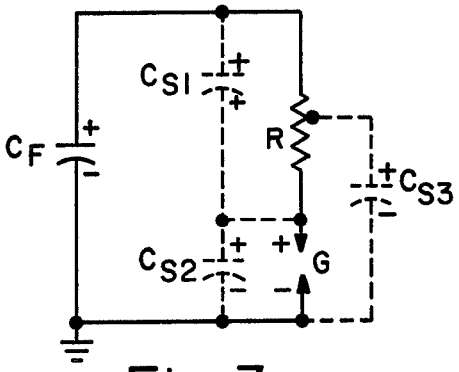
FIGS. 3–5 are highly schematic diagrams showing certain effects of stray capacitance on arcing in a tube.
Figure 4:
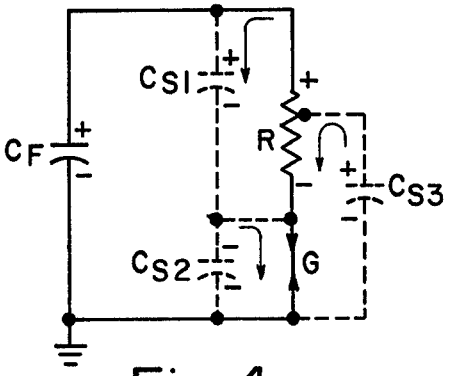
Figure 5:
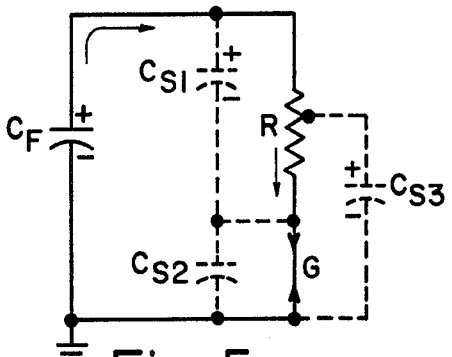

FIG. 8 also shows in symbolic form the same representative stray capacitance $C_{S1}$, $C_{S2}$, $C_{S3}$ described above in connection with FIGS. 3–5. Thus it is seen that the actual total arc suppression network is really the sum of the parallel resistance 92, 94, 138 and 140 and all of the pertinent stray capacitances (here represented only by capacitances $C_{S1}$ and $C_{S3}$). If an arc current can find a low impedance path in any one or more of these branches of the system, then the system has failed in its job to protect the gun and associated chassis circuitry from high level arc currents.

By selecting appropriate values for the resistance of the arc suppression resistor 92 and anti-static coating 94, as described above, very adequate arc suppression will be achieved if the resistance values of the surface conduction resistros 138 and 140 can be made large enough and if the values of the stray capacitances can be made small enough. The matter of surface resistance will be considered shortly hereinafter. In accordance with this invention, the stray capacitances in the resistive system are made very small by the following measures. The arc suppression resistor is caused to be as small as possible and to be spaced as far as possible from the anti-static coating 94 and other internal and external tube components. The area of both the arc suppression resistor 92 and anti-static coating 94 are minimized. Further, arc suppression is enhanced by assuring that as much stray capacitance as possible is placed in series with a large resistance so that the said arc precursors are damped to minimize the energy in the precursors and to reduce the likelihood that a main arc discharge will occur.

The matter of the surface resistance of the arc suppression resistor 92 and anti-static coating 94 will now be treated. As explained above, many prior art suppression elements are susceptible to having their dynamic impedance drastically reduced by getter flash deposits. In the preferred FIG. 6 embodiment, the location of the arc suppression resistor 92 and anti-static coating 94 down in the neck of the tube, the orientation of their exposed surfaces generlly parallel to the direction of getter material projection and the small area of the exposed surface thereof, all contribute to making the system relatively immune to the effects of getter flash deposits.

The tolerance of the system to getter flash deposits is also enhanced by causing the anti-static coating 94 and the arc suppression resistor 92 to each have a surface, the topography of appropriate which is so irregularized that flashing of getter material thereon is not effective to materially reduce the dynamic impedance thereof or to pre-dispose the surface thereof to arc propragatin. The irregularization of the surface topography of the resistor 92 and anti-static coating 94 is not part of the present invention, per se, but is described and claimed in the referent copending application Ser. No. (2842). It has been found that irregularization of the surface of the arc suppression resistor 92 and anti-static neck coating 94 may not be imperative in an embodiment as illustrated in FIG. 6 wherein the tube is of the small neck variety and these resistive elements have the FIGS. 6 and 7 geometry. The initial amount of getter material deposited, the angle of impingement of the getter material, and the limited area of the resistive elements exposed to getter flash apparently diminish the getter-flash deposition problem.

In the illustrated embodiment the arc suppression tresistor 92 is shown, as noted, as comprising a ceramic rod 114 upon which is deposited a high resistivity coating 120. The coating 120 preferably has for enhanced getter flash tolerance, the novel topographical structure according to the aforesaid invention. The anti-static coating 94 preferably also has the same irregularized topographical structure. As will be explained in more detail, the real surfaces of the coatings 120 and 94 are each so widely and deeply cavitated and contorted at and below the nominal surface thereof that is shadowed and many times increased in area relative to the said nominal surface. The result is that the dynamic impedance of the system comprising the arc suppression resistor 92 and anti-static coating 94 is not materially reduced as a result of a normal getter flash. Further, any increase in the tendency of arcs to travel over the surface of the coatings 94, 120 as a result of getter flash deposits is tolerably insignificant. This is due to the fact that the getter material deposited on the real surfaces of the coatings 94, 120 is effectively dispersed and fragmented into isolated conductive islands spread over a very greatly increased real surface area.

Although a variety of materials may be employed, the resistive material utilized for the coatings 94, 120 is resistive frit material containing a metallic modifier such as tin oxide in an amount apropriate to give the frit the desired resistivity. The thickness of the coating 120 may, e.g. be approximately 0.2–5.0 mils. The coating 94 is caused to have a higher resistance by making it thinner than coating 120 — e.g. a few ten thousandths of an inch thick. A method by which the surface may be caused to have the porated, heavily cavitated and contorted surface of greatly extended real surface area will now be described.

One method of making relatively getter-flash-tolerant resistive element is as follows. The resistive frit coating may have the following composition, prepared in the form of a suspension: 7.2 grams of ball-milled resistive frit supplied by Corning Glass Works of Corning, New York as Glass 8464; 1.8 grams of vehicle F1300A supplied by the Pierce and Stevens Company of Buffalo, N.Y., or equivalent; 1.8 grams of camphor; and 1.2 grams of ethyl propionate or equivalent. The suspension may be applied by brushing, spraying, dipping or other suitable process. The thickness of the coating will affect the resistance thereof — the thinner the coating, the greater its resistance. The resistance of the coating can thus be controlled both by the amount of metallic inclusion and by the coating thickness.

The surface irregularizing agent in the formulation being discussed is camphor. Crystallization of the camphor from the suspension causes the surface of the coating to have the afore-described extremely irregular topography. The next step in the method of coating fabrication under description is to vacuum bake the coating, for example for 20 minutes at about 430° C. This step can be accomplished as part of the normal exhaust cycle. This has the effect of devitrifying the frit to form an extremely hard and abrasion-resistant vitreous coating. During the vacuum bake step, the resistance of the coating achieves its ultimate useful value which may be several orders of magnitude less than its resistance after air bake.

A number of production prototype tubes have a parallel resistive network comprising an anti-static coating and discrete resistor as shown in FIG. 6 were constructed and very successfully tested. The getter in each tube was a standard gun-mounted, antenna-type gas-doped barium getter. The low voltage D.C. resistance of the resistive sytem was about 1 megohm. The tubes were given high voltage arcing tests and proved to hold up without arcing at 40 Kv, 45 Kv, 50 Kv or even higher before significant arcing occurred. When the tubes did arc, which was less often than in non-arc-suppressed tubes of similar construction, arc currents typically had a value of no more than a relatively harmless one ampere or less. The precursor spikes were a few amperes in magnitude — not enough to cause impairment of the tube or chassis structure or function.

Figure 9:
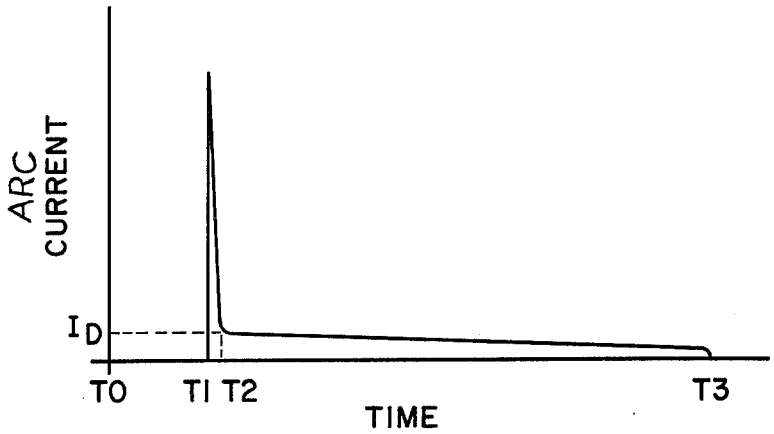
FIG. 9 is an arc-current-versus-time characteristic for a color CRT having an arc suppression and anti-static system as shown in FIG. 6.

A schematic representation of an arc current trace on an oscilloscope is shown in FIG. 9. The value $I_D$, the peak arc current, registered typically less than one ampere — for example 0.5 ampere. Assuming a breakdown voltage of 50 kilovolts, this implies a dynamic impedance of about 100,000 ohms. Typically, the measured dynamic impedance values for the prototype tubes tested fell in the range of 5–20 times lower than the low voltage D.C. resistance of the resistive system. The difference between the measured low voltage D.C. resistance values and the dynamic impedance values is believed to be due to the voltage sensitivity of the resistive elements and perhaps to high voltage aging of the resistors. The dynamic impedance values of the resistive elements is believed to be substantially equal to the high voltage D.C. resistance thereof.

The test results show the system according to this invention to be extremely effective in suppressing arcs to a level so low as to be incapable of causing damage to tube or chassis components or to impair the performance of either. The relative immunity of the FIG. 6 resistive system to the deposition of conductive material during getter flash ahs also been proved. Tests on prototype tubes as shown in FIG. 6 having resistive frit coatings 94, 120 — a number made with and a number made without the use of camphor as a surface irregularization agent — showed a decrease in the low voltage D.C. resistance of the system by about 15–30%. We believe that the decrease in the dynamic impedance of this system due to flashing of the getter would be in the same order of magnitude. A drop of only 15–30% in the dynamic impedance of this sytem as a result of getter flash is not deemed to have a material effect on the performance of the system.

As stressed many times before, one of the chief attributes of the system of parallel resistance elements comprising a discrete arc suppression resistor paralleled with an antistatic neck coating having a very high resistance, is the very low stray capacitance of the system and the fact that much of the stray capacitance is strongly damped by the presence of resistance in series therewith. The low stray capacitance of the system, even in spite of getter flash deposits, assures that the dynamic impedance of the system to arc currents remains at substantially the same high level as the D.C. resistance of the system before arcing occurs.

Figure 1:
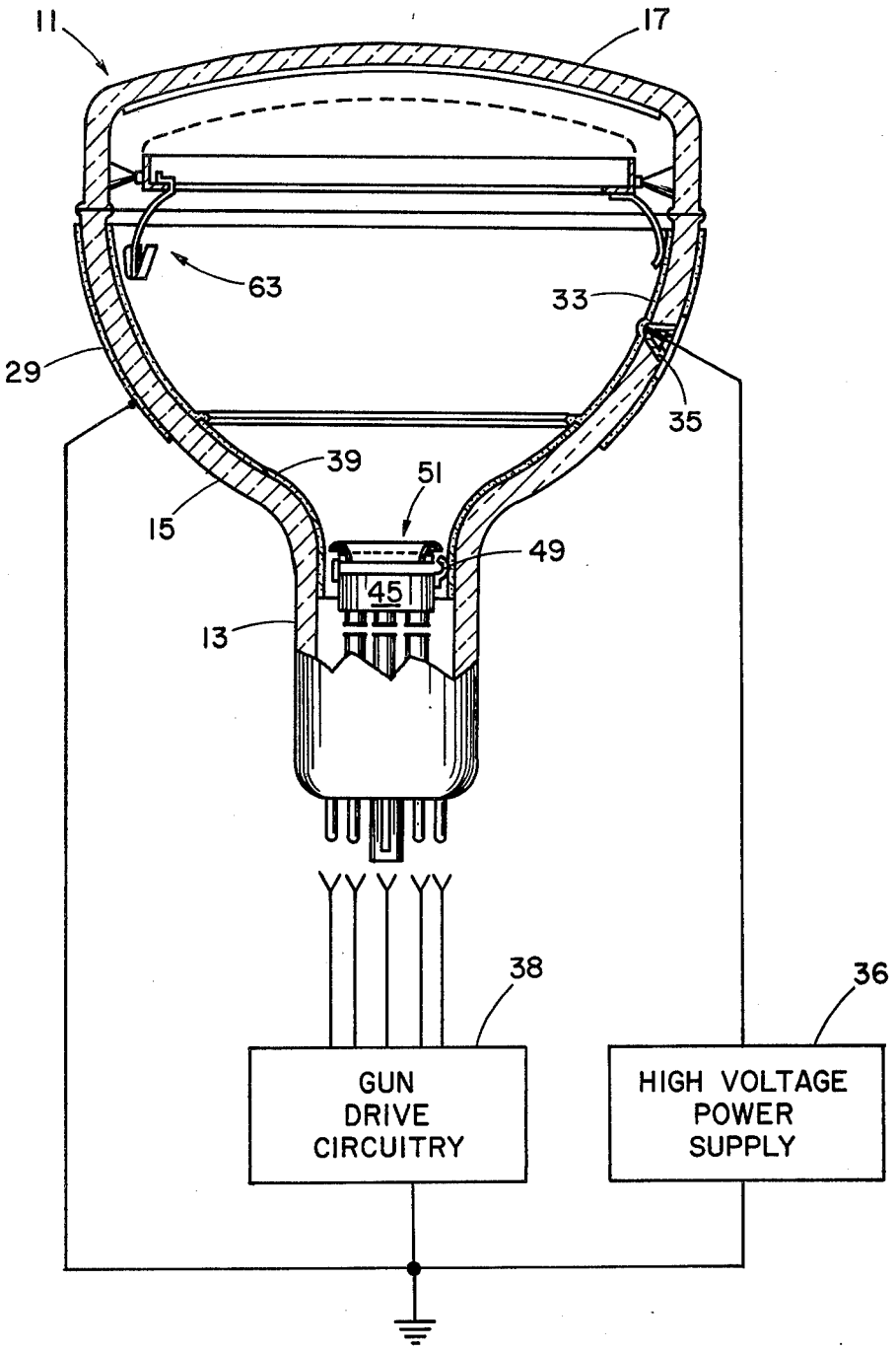
Fig. 1 PRIOR ART
FIG. 1 is a view of FIG. 1 of U.S. Pat. No. 3,979,633 with selected reference numerals removed and elements 36 and 38 added.
Figure 2:
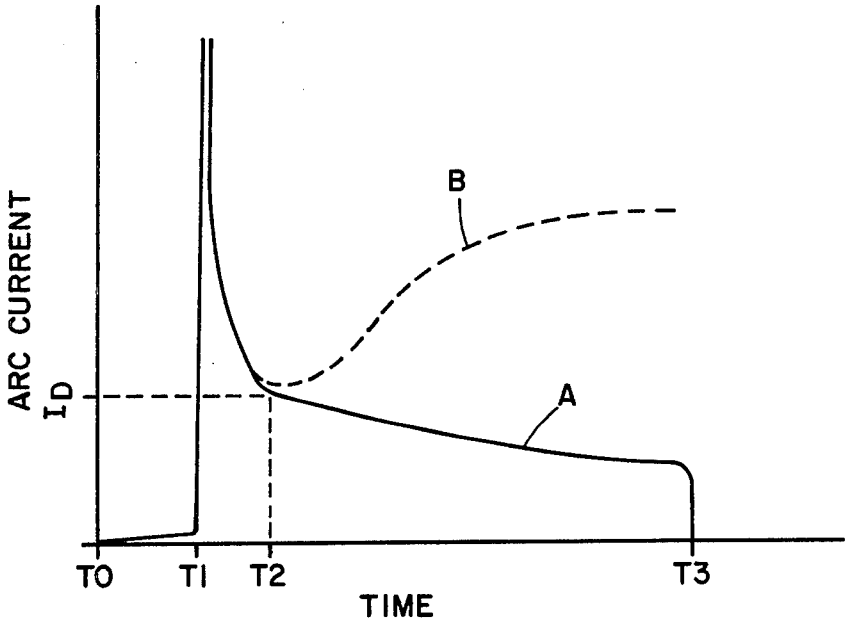
FIG. 2 is an arc-current-versus-time characteristic for a hypothetical prior art arc-suppressed television CRT.

It is a stated object of this invention to provide for a television CRT an arc suppression system which is so effective as to greatly reduce the number, as well as the intensity, of arcs which do occur. Recall in connection with the discussion of FIGS. 2–5 that before an arc discharges across a gun interelectrode gap (or elsewhere), a low level flow of charged particles occurs. This was called the precursor ramp and is shown in FIG. 2 between times $t_0$ and $t_1$.

In FIG. 10, curves 140, 142 and 144 represent a hypothetical family of gap-voltage-versus-gap-current characteristic curves for a vacuum gap across which an arc discharge is struck. The different characteristic curves 140, 142, 144 represent a given tube under different conditions of cleanliness, age, etc. Each tube will have a different family of characteristic curves depending on its distincitive physical properties.

It can be seen that each of the curves has three distinct regions — a stable positive resistance region (labeled "A") in which increasing gap voltage results in increasing gap current. The characteristic curves have a knee region ("B"), the tip of which may be said to represent a zero resistance point in which current increases absent any increase in gap voltage. The knee of the characteristic merges into an unstable negative resistance region ("C") wherein gap current increases are associated with falling gap voltages. The Y-axis of the FIG. 10 plot is on a log scale. The current values in the negative resistance region are extremely high and represent conditions wherein the gap is bridged by an arc discharge.

On FIG. 10 is drawn a load line "LL" for the arc gap circuit comprising the anode voltage source, the arc suppression resistive system, and a selected interelectrode gap in the electron gun. The load line LL defines the range of possible operating points for the circuit. The intersection of the X-axis by the load line is determined by the anode voltage; the slope of the curve is determined by resistance value of the arc-suppression resistive system. The points of intersection of the load line LL with the characteristic curves 140, 142, 144 are the possible operating points of the arc gap circuit.

In accordance with an aspect of this invention, in order to reduce the number as well as the intensity of arcs which occur in a television CRT, the dynamic impedance of the arc suppression resistive system is caused to be so great that the load line LL intersects the characteristic curves in the stable positive resistance region (A), e.g. at points $P_1$, $P_2$, $P_3$. When the arc gap circuit is operating under these constraints, the arc precursor currents can never reach the knee of the operating characteristic, thus preventing an arc discharge breakdown across the gap. As a practical matter, it is difficult to make tubes in which the afore-said operating points are at all times below the knee of the characteristic curve. As a result, tubes have not yet been constructed in which no arcing whatsoever occurs, however progress is being made toward that goal by the employment of the present invention.

It is believed that prior art practitioners did not appreciate the above. Prior art tubes are commonlysuggested to have arc suppression resistors with values which would result in load lines such as LL' creating operating points $P_1'$, $P_2'$ and $P_3'$ in the unstable arcing region C of the characteristic curves. The operating conditions in such a tube are thus not such as to inhibit the occurrence of arcs.

The high voltage dynamic impedance values were taken using test apparatus shown schematically in FIG. 11. Where reference numerals are employed in FIG. 11 which are common to reference numerals used earlier, they are intended to designate like elements. It is believed that FIG. 11 is selfexplanatory. Dynamic impedance values were calculated by noting the current level at which the filter capacitor 136 discharged ($I_D$ in FIG. 9), and dividing this number into the applied screen voltage at breakdowns which appears across the filter capacitor 136.

Whereas the above description has been directed to standard television tubes, other discrete resistors according to this invention could be employed. The neck coating could be composed of materials other than resistive frit — e.g. tungsten iridium or other suitable metallic resinates. Other changes may therefore be made in the above-described apparatus without departing from the true spirit and scope of the invention herein involved and it is intended that the subject matter in the above depiction shall be interpreted as illustrative and not in a limiting sense.

What is claimed is:

1. In a television cathode ray tube including an evacuated glass envelope having on an external surface of a funnel portion thereof an outer conductive coating and on an internal surface thereof an inner conductive coating for receiving a high voltage charge, said tube further comprising an electron gun located in a neck of the funnel, the tube being characterized by having an arc-suppression and static-elimination system comprising a discrete, non-distributed arc suppression resistor having a relatively low distributed capacitance and means for electrically and mechanically coupling said arc suppression resistor between said inner conductive coating and said electron gun, and in electrically parallel combination with said arc suppression resistor, an anti-static coating deposited on an inner surface of the neck around the beam egress from said gun.

2. The apparatus defined by claim 1 wherein said dynamic impedance of said arc suppression resistor is in the range of 0.1–5 megohms and the dynamic impedance said anti-static neck coating is in the range of $10^7$ – $10^9$ ohms, insuring that any arc currents are low in magnitude and flow predominantly through said discrete arc suppression resistor rather than through said anti-static neck coating.

3. In a television cathode ray tube including an evacuated glass envelope having on an external surface of a funnel portion thereof an outer conductive coating and on an internal surface thereof an inner conductive coating for receiving a high volage charge, said tube further comprising an electron gun located in a neck of the funnel, the tube being characterized by having an arc-suppression and static-elimination system comrising a discrete, non-distributed arc suppression resistor having a relatively low distributed capacitance and having a dynamic impedance value in the range of a few kilohms to tens of megohms, and means for electrically and mechanically coupling said arc suppression resistor between said inner conductive coating and said electron gun, and in electrically parallel combination with said ar supression resistor, an anti-static coating deposited on an iner surface of the neck around the beam egress from said gun and having a dynamic inpedance value which is greater than that of said arc suppression resistor such that said resistor carries the major part of any arc currents passing through said system, whereby effective arc suppression and static elimination are achieved with high dynamic impedance and wih an insubstantial likelihood of said system being by-passed as a result of stray capacitance in the neck of the tube.

4. The apparatus defined by claim 3 wherein said dynamic impedance of said arc suppression resistor is in the range of 0.1–5megohms and the dynamic impedance said anti-static neck coating is in the range of $10^7$ – $10^9$ ohms, insuring that any arc currents are low in magnitude and flow predominantly through said discrete arc suppression resistor rather than through said anti-static neck coating.

5. In a television cathode ray tube including an evacuated glass envelope having on an external surface of a funnel portion thereof an outer conductive coating and on an internal surface thereof an inner conductive coating for receiving a high voltage charge, said tube further comprising an electron gun located in a neck of the funnel, and having a gun-mounted, antenna-type getter containing a vaporizable, electrically conductive, gas-adsorptive getter material, the tube being characterized by having an arc-suppression and static-elimination system comprising a discrete, non-distributed arc suppression resistor mounted on the forward end of said gun and supporting said getter in electrical contact with said inner conductive coating and having a relatively low stray capacitance and a dynamic impedance value in the range of a few kilohms to tens of megohms, and in electrically parallel combination with said discrete arc suppression resistor, a resistive anti-static coating deposited on an inner surface of the neck around the beam egress from said gun and having a dynamic impedance value which is greater than that of said arc suppression resistor such that said resistor carries the major part of any arc currents passing through said system, whereby effective arc suppression and static elimination are achieved with high dynamic impedance and with an insubstantail likelihood of said system being bypassed as a result of stray capacitance in the neck region of the tube.

6. The apparatus defined by claim 5 wherein said arc suppression resistor is a discrete resistor comprising a substrate on which is disposed a coating of resistive frit material having a dynamic impedance in the range of 0.1–5 megohms, and wherein said anti-static coating is composed of resistive frit material.

7. In a television cathode ray tube including an evacuated glass envelope having on an external surface of a funnel portion thereof an outer conductive coating and on an internal surface thereof an inner conductive coating for receiving a high electrical potential, said tube further comprising an electron gun located in a neck of the funnel and a getter comprising a pan containing a varporizable, gas-adsorptive material and a leaf spring support for the pan, the tube having an arc-suppression and static-elimination system comprising a discrete arc suppression resistor mechanically anchored to the forward end of said gun and supporting said getter in contact with said inner conductive coating such that said arc suppression resistor is electrically connected in series with said gun, with said getter and with said inner conductive coating, said arc-suppression resistor being spaced from the inner wall of said neck such that said resistor has a relatively low stray capacitance, said appratus including a resistive anti-static coating deposited on the inner surface of said neck around the beam egress from said electron gun and having a dynamic impedance value in the range of about $10^7 - 10^9$ ohms and greater than the dynamic impedance value of said discrete arc suppression resistor to present a high dynamic impedance to transient arc currents, said anti-static coating being electrically and mechanically coupled to said inner conductive coating to collect and drain off beam-related stray electron charge, whereby effective arc suppression and static elimination are achieved with high dynamic and static impedance and with an insubstantial likelihood of said system being by-passed as a result of stray capacitance in the neck region of the tube.

8. In a television cathode ray tube including an evacuated glass envelope having on an external surface of a funnel portion thereof an outer conductive coating and on an internal surface thereof an inner conductive coating for receiving a high voltage charge, said tube further comprising an electron gun located in a neck of the funnel, the tube being characterized by having an arc-suppression and static-elimination system comprsing a discrete, non-disributed arc suppression resistor having a relatively low distributed capacitance, and means for electrically and mechanically coupling said arc suppression resistor between said inner conductive coating and said electron gun, and in electricaly parallel combination with said arc suppression resistor, an anti-static coating deposited on an inner surface of the neck around the beam egress from said gun, the dynamic impedance of said system being caused to be so great that the number and intensity of arcs which occur are greatly suppressed.

* * * * *

UNITED STATES PATENT OFFICE

CERTIFICATE OF CORRECTION

Patent No. 4,101,803 Dated July 18, 1978

Inventor(s) Retsky et al

It is certified that error appears in the above-identified patent and that said Letters Patent are hereby corrected as shown below:

Column 1, line 43, delete "shoudl" and insert --should--;

Column 1, line 66, delete "desing" and insert --design--;

Column 2, line 2, delete "consuption" and insert --consumption--;

Column 2, line 44, after "protecting" insert --a--;

Column 3, line 61, delete "Our" and insert --One--;

Column 7, line 31, please underscore the word "discrete";

Column 9, line 60, delete "nck" and insert --neck--;

Column 10, line 25, delete "Antistatic" and insert --Anti-static--;

Column 10, lines 53 & 54, delete "discused" and insert --discussed--;

Column 12, line 13, delete "filer" and insert --filter--;

Column 12, line 56, delete "modes" and insert --modest--;

Column 12, line 61, delete "the" (first occurrence) and insert -- that --;

Column 12, line 63, delete "inteval" and insert --interval--;

Column 13, line 32, delete "resistros" and insert --resistors--;

CERTIFICATE OF CORRECTION

Patent No. 4,101,803 Dated July 18, 1978

Inventor(s) Retsky et al

It is certified that error appears in the above-identified patent and that said Letters Patent are hereby corrected as shown below:

Column 13, line 56, delete "generlly" and insert --generally--;

Column 13, line 64, delete "appropriate";

Column 13, line 67, delete "propragatin" and insert --propagation--;

Column 14, line 15, delete "tresistor" and insert --resistor--;

Column 14, line 40, delete "apropriate" and insert --appropriate--;

Column 15, line 23, please add after "a" --mere--;

Column 15, line 48, delete "ahs" and insert --has--;

Column 16, line 20, delete "distincitive" and insert --distinctive--;

Column 16, lines 64 & 65 delete "commonlysuggested" and insert --commonly suggested--;

Column 17, line 8, delete "selfexplanatory" and insert --self-explanatory--;

Column 17, line 54, delete "volage" and insert --voltage--;

Column 17, line 57, delete "comrising" and insert --comprising--;

Column 17, line 64, delete "ar" and insert --arc--;

Column 17, line 66, delete "iner" and insert --inner--;

UNITED STATES PATENT OFFICE

CERTIFICATE OF CORRECTION

Patent No. 4,101,803 Dated July 18, 1978

Inventor(s) Retsky et al

It is certified that error appears in the above-identified patent and that said Letters Patent are hereby corrected as shown below:

Column 17, line 67, delete "inpedance" and insert --impedance--;

Column 18, line 4, delete "wih" and insert --with--;

Column 18, line 40, delete "insubstantail" and insert --insubstantial--;

Column 18, line 56, delete "varporizable" and insert --vaporizable--;

Column 18, lines 66 & 67, delete "apratus" and insert --apparatus--;

Column 20, line 4, delete "comprsing" and insert --comprising--;

Column 20, line 5, delete "disributed" and insert --distributed--;

Column 20, line 9, delete "electricaly" and insert --electrically--;

Signed and Sealed this

*Sixth* Day of *February 1979*

[SEAL]

*Attest:*

RUTH C. MASON
*Attesting Officer*

DONALD W. BANNER
*Commissioner of Patents and Trademarks*